US005117813A

United States Patent [19]

Haxton et al.

[11] Patent Number: 5,117,813

[45] Date of Patent: Jun. 2, 1992

[54] THERAPEUTIC APPARATUS FOR MOTOR IMPROVEMENT

[76] Inventors: Kristine M. Haxton; Newell Haxton, both of 1093 S. Finley Rd., Lombard, Ill. 60148

[21] Appl. No.: 664,284

[22] Filed: Mar. 5, 1991

[51] Int. Cl.[5] ..... A61H 1/02

[52] U.S. Cl. ..... 128/25 R; 434/407; 434/247

[58] Field of Search ..... 128/24 R, 25 R; 272/93; 273/1.5 A; 434/247, 248, 258, 407, 408, 416, 420; 248/450; 446/901

[56] References Cited

U.S. PATENT DOCUMENTS 3,006,644 10/1961 Usher et al. ..... 272/93

FOREIGN PATENT DOCUMENTS 0440765 5/1912 France ..... 128/25 R 0025560 of 1909 United Kingdom ..... 128/25 R

*Primary Examiner*—Richard J. Apley
*Assistant Examiner*—Susan L. Weinhoffer
*Attorney, Agent, or Firm*—Olson & Hierl, Ltd.

[57] ABSTRACT

An apparatus for achieving motor improvement of a neurologically and/or orthopedically disordered limb of a patient is provided along with a method of use. The apparatus incorporates a frame supported panel on which is adjustably and diagonally mounted an elongated member that has associated therewith a releasable attachment member. A releasably supportable portable marker member that is also releasably engagable with the releasable attachment member is provided. Thus, the patient after being suitably oriented relative to the apparatus, can raise a limb, fasten the marker member to the elongated member, and then lower the limb in a controlled, repetitive manner.

11 Claims, 2 Drawing Sheets

THERAPEUTIC APPARATUS FOR MOTOR IMPROVEMENT

FIELD OF THE INVENTION

The present invention relates to an apparatus which enables a patient to increase the neuromuscular performance of an impaired limb.

BACKGROUND OF THE INVENTION

Patients who have suffered neurological and/or orthopedic disorders usually experience an impairment in limb function. Occupational therapy under the guidance of a trained therapist who uses proprioceptive neurofacililation (PNF) techniques or the like can increase the functional strength, range of motion and endurance of the patent. Repetitive patterns of exercise are necessary to achieve such an increase.

However, experience shows that patients are often unlikely to carry out the necessary exercise patterns for as long and as often as is necessary to achieve the desired improvements. Also, for reasons of cost availability and convenience, a given patient may need to carry out such a pattern of exercises without the benefit of a trained therapist being present.

A simple, durable, low maintenance apparatus is needed which can be used by a patient in a safe and reliable manner with a minimum of preliminary instructional training and experience. Also, the apparatus should be usable for therapy in treating a wide variety of neuromuscular disorders. Suitable prior art devices are not now known. The present invention, however, provides such an apparatus and includes methods for its use.

SUMMARY OF THE INVENTION

The present invention provides an apparatus and method which enable a patient to increase the neuromuscular functional performance of an impaired limb.

The apparatus incorporates a frame and a frame supported panel which is elevated and preferably vertically disposed relative to a lower, substantially flat, horizontal surface. Optionally, the panel can be tiltable. The panel has adjustably and diagonally mounted thereacross at least one elongated member which has associated therewith at least one releasable attachment means. The elongated member can be marked at a number of predetermined locations along its length.

In a preferred embodiment, the panel is associated with at least two elongated members which differ from one another with regard to their respective releasable attachment means. For example, and in a presently most preferred embodiment, two elongated members are utilized. Each elongated member can comprise a portion of a yardstick or the like, if desired.

One elongated member is provided with a plurality of adhered, longitudinally regularly spaced, strips or sections that are each preferably in a square or rectangular perimeter configuration which include a self-adhering but releasable surface. Preferably, each section is comprised of a "Velcro" type hook and loop fastening material.

The second elongated member is associated with a dowel rod that is attached at a lower end portion of the elongated member and that extends in spaced parallel relationship along the elongated member to an open upper end portion thereof. The spacing between the rod and the associated elongated member is such that a ring or similar member can engage and can slide along the dowel rod.

The apparatus further utilizes a digitally supportable (that is, by fingers or perhaps toes) portable marker means that is itself associated with supporting means and is adapted to engage the releasable attachment means of the elongated member substantially upon contact therewith.

The present invention also provides methods for using the apparatus. Thus, in a presently preferred method of use, a patient is positioned in a spaced adjacent relationship to the apparatus so that his torso is generally parallel or perpendicular to the supported panel. Mounted on the supported panel in a desired inclined position is at least one elongated member as described above. Commencing from a location spatially adjacent to the surface of the supported panel, but which preferably is somewhat below the bottom of the panel, the patient executes an arcuate, swinging movement of his impaired arm while grasping in the associated hand a portable marker means that is engagable with the releasable attachment means associated with the chosen straight member. At a maximum elevated position of the attainable arm movement, the patient engages the portable marker means with the releasable attachment means, releases the marker means and lowers his arm in a relatively controlled manner.

Other and further objects, purposes, features, advantages, embodiments and the like will be apparent to those skilled the art from the following description taken with the accompanying drawings and the appended claims.

BRIEF DESCRIPTION OF THE DRAWINGS

In the drawings, which comprise a portion of this disclosure.

DETAILED DESCRIPTION

Figure 1:
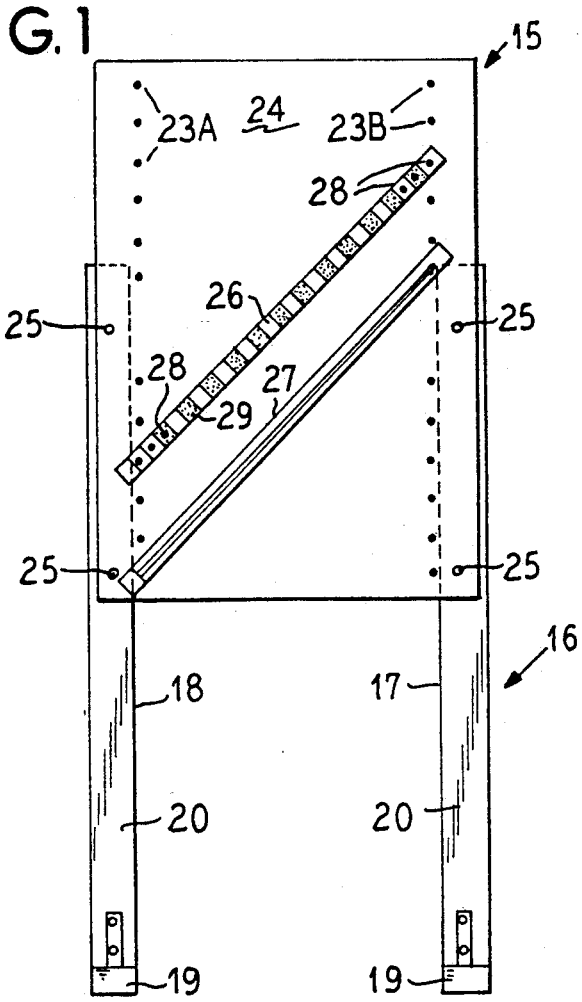
FIG. 1 is a front elevational view of one embodiment of a therapeutic apparatus of the present invention.
Figure 2:
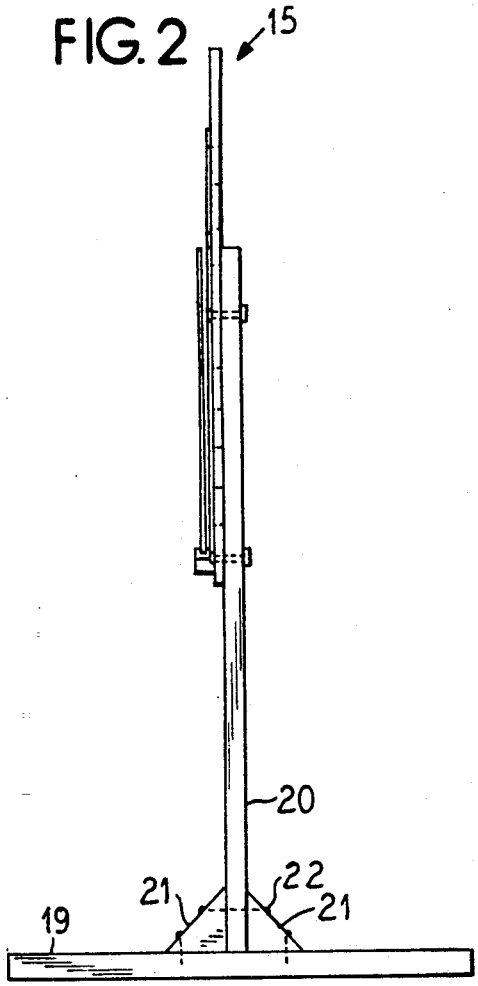
FIG. 2 is a side elevational view of the embodiment shown in FIG. 1.

Referring to FIGS. 1-6, one embodiment of therapeutic apparatus of the present invention is designated by the numeral 15. Apparatus embodiment 15 incorporates a frame assembly 16 that comprises a pair of supports 17 and 18, each one of which includes a horizontally extending floor engaging member 19 and an upstanding preferably vertical member 20 extending from a mid-region of each member 19. A pair of equilateral triangular corner braces 21 is arranged one on each side of member 20 adjacent the lower end thereof and is used to mount member 20 in an upright position relative to member 19 by means of screws 22 or the like.

Supports 17 and 18 are placed in spaced parallel relationship to each other, and a panel 24 is mounted to the upright members 20 by nut and bolt assemblies 25 or the like so that the panel 24 is held in a spaced relationship to the floor.

The frame assembly 16 and the panel 24 can be comprised of any convenient or desired construction material including wood, molded plastic, or the like. For example, panel 24 can comprise plywood, fiberboard, pegboard (i.e., fiberboard with a plurality of regularly spaced preformed holes extending therethrough), plastic self-supporting thickened sheeting, laminates of cellulosic and plastic materials, and the like. Also, the frame assembly 16 can have any convenient or desired structure.

The frame 16 and the panel 24 can be configured in any convenient but cooperating sizes. For example, for use in arm therapy, it is presently convenient and preferred to use a frame 16 that is about six feet tall and to use a panel 24 that is about three feet high and about two and one half feet wide. A width of about 28-30 inches is presently preferred as a panel width, for reasons of wheel chair accessibility, as those skilled in occupational therapy will appreciate.

Conveniently and preferably, a frame assembly 16 can be provided with casters (not shown), such as casters of the conventional type which recede into a socket when a small load (i.e., a weight) is placed on the frame assembly. Thus, the tendency of the frame assembly to roll or move is minimized during patient use. Bottom surface portions of the floor engaging members 19 can be provided with a friction resistant or even floor adhering substance (not shown), if desired, as those skilled in the art will appreciate. Casters are sometimes desirable since they enable the apparatus to be moved from one area of a clinic to another.

The panel 24 has diagonally mounted across a front side thereof at least one elongated member, such as an elongated member 26 or an elongated member 27. In a preferred embodiment 15 such as shown, both members 26 and 27 can be provided.

A present preference is to provide a panel 24 which generally has a solid or continuous structure, and which is provided with two sets or pluralities 23A and 23B of regularly spaced, generally vertically aligned holes that extend therethrough. Such sets 23A and 23B are positioned so that each extends along an inside edge of a different upstanding member 20.

Each elongated member, such as members 26 and 27, is conveniently provided with a plurality of longitudinally equally spaced holes that extend therethrough, such as holes 28 in opposite end regions of elongated member 26.

Thus, a single nut and bolt assembly, with the nut conveniently being of the winged typed for convenience in use (not detailed), can be used to mount each opposite end portion of an elongated member, such as a member 26 or 27, to the panel 24. The various series of holes permit great variations to be achieved in the angle of inclination of an individual elongated member, such as members 26 and 27, as desired.

Any convenient means can be employed to provide the desired adjustable mounting and positioning capability for the elongated members, such as members 26 and 27, relative to the panel 24, as those skilled in the art will appreciate. For example, it is preferred to position a bolt within each hole of the panel 24 and secure the bolt with a conventional hex nut or the like so that the threaded portion of the bolt extends towards the patient. In this manner, the elongated members 26 and 27 can be readily positioned simply by placing the elongated member over the bolt so that the threaded portion extends through the hole 28 of the elongated member. A wing nut or the like can then be threadably received over the end of the bolt to secure the elongated member in position.

Each elongated member, such as members 26 or 27, is characterized by having associated therewith releasable attachment means and also by having, optionally but preferably, distance intervals marked therealong. The elongated members can be comprised of wood, metal, plastic, or the like. The distance intervals serve as a means for indicating the level of achievement (i.e., limb movement) attained by the patient. The releasable attachment means serves to provide a mounting location for a portable marker means provided by this invention that is releasably carried by (i.e., held by) the patient (i.e., by the fingers or perhaps by the toes of the limb being exercised by the patient).

Thus, for example, elongated member 26 or elongated member 27 is conveniently a yardstick graduated in inches, or a meter stick graduated in centimeters, decimeters or the like, as desired (the incremental graduations not being detailed in the Figures). The member 26 has mounted at preferably longitudinally equally spaced intervals along the length thereof using an adhesive or the like (not shown), a plurality of strips 29 or other shaped pieces of material having a self-adhering but releasable surface structure. Rectangular or square shaped material strips 29 are presently preferred.

A presently preferred surface structure comprises a hook and loop fastening means, such as is available commercially under the trademark "VELCRO." A presently most preferred spacing between individual strips 29 along member 26 is about two inches with the longitudinal length of each individual fastening strip 29 being about two inches. The width of each strip 29 thereof can be determined by the width of an elongated member 26.

Figure 3:
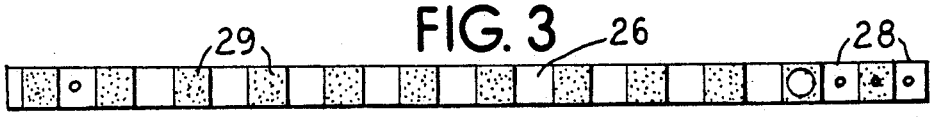
FIG. 3 is a plan view of a hook and loop equipped elongated member that is utilized in the embodiment shown in FIG. 1 and shows the elongated member associated with a corresponding hook and loop equipped marker block.
Figure 4:
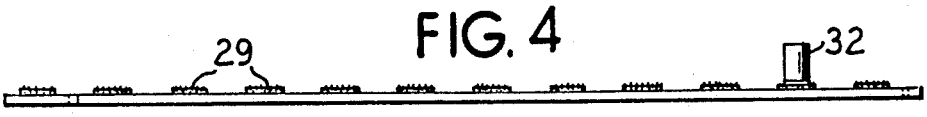
FIG. 4 is a side elevational view of the elongated member assembly shown in FIG. 3.

Member 26 is particularly convenient, and is presently preferred, for use by patients who possess sufficient motor control in the limb that is undergoing treatment using the apparatus of this invention to be able to grasp, position and release by the fingers (or toes) a portable marker member 32, such as shown in FIGS. 3 and 4.

The marker member 32 that can be used in association with the member 26 can have many different forms. One preferred form as shown in FIGS. 3 and 4 utilizes a solid cylindrical body which is conveniently comprised of a short segment of a wooden or plastic dowel rod. For example, in a presently preferred form, this body has a diameter of about 1 inch and a length of about two inches; however, larger and smaller dimensions may be employed, if desired. For example, the body can comprise a baton-like portion with a Velcro portion attached thereto. Over one flattened end of the body is mounted, by an adhesive or the like (not shown), a piece of a self-adhering releasable material, such as a "Velcro"-type of hook and loop material, which is engagable with a strip 29 that is comprised of a corresponding engagable material.

In another embodiment, the elongated member assembly 27 and cooperating ring marker member 33 are provided. Member 27 is associated with a dowel-type wood, plastic or metal rod 30 that extends in spaced, parallel relationship to member 27 along the front face thereof. Rod 30 terminates at its uppermost end in an open end configuration while its lowermost end is associated with the straight member 27. The association is illustratively achieved by seating the lower end of the rod 30 in a channel formed in the block 31, and block 31 is adhered along one side thereof by an adhesive (not shown) or the like to an adjacent end region of elongated member 27. The lower end of elongated member 27 can itself be seated in a channel formed in an extension of block 32, as shown in FIG. 6.

Figure 5:
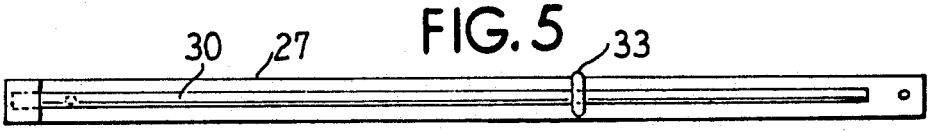
FIG. 5 is a plan view of the dowel rod-equipped elongated member that is utilized in the embodiment shown in FIG. 1 showing the elongated member associated with a marker ring.
Figure 6:
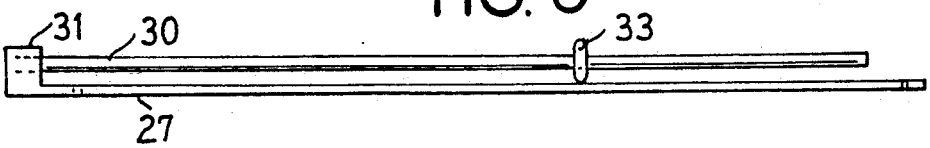
FIG. 6 is a side elevational view of the elongated member assembly shown in FIG. 5.

With this assembly, a patient may place a ring-type marker member 33, such as shown in FIG. 5 and 6, over the open end of dowel rod 30, and then allow the marker member 33 to slide downwards along the rod 30. The patient preferably controls the sliding movement of the marker member 33 along the rod 30 by maintaining a grasp on the marker member 33. This increases the range of motion of the limb during the exercise.

A marker means that is employable with the elongated member assembly 27 can have many different forms. The presently preferred form as described with reference to FIGS. 5 and 6 utilizes the marker member 33 in a ring or toroidal form that is comprised of wood, plastic, or the like. The relationship between the open central region of the ring and the diameter of the toroidal region thereof is such that the ring-type marker member 33 can slidably extend over the rod 30 when the member 27 is in a desired diagonal position.

In one form of the invention, the marker member 33 is sized so as to be slightly frictionally engagable with the rod 30 and the adjacent surface of straight member 27. With this arrangement, a patient can use downwardly exerted motor control to position the ring-type marker member 33 over the rod 30 once the member 33 is hooked by the patient This is desirable in some forms of therapy The ring-type marker member 33 can also include a Velcro portion so that the ring member can also be used with the Velcro-containing elongated member 26.

For reasons of versatility, it is preferred to equip the apparatus with both types of elongated members 26 and 27, or the equivalent, as those skilled in the art will appreciate.

Figure 7:
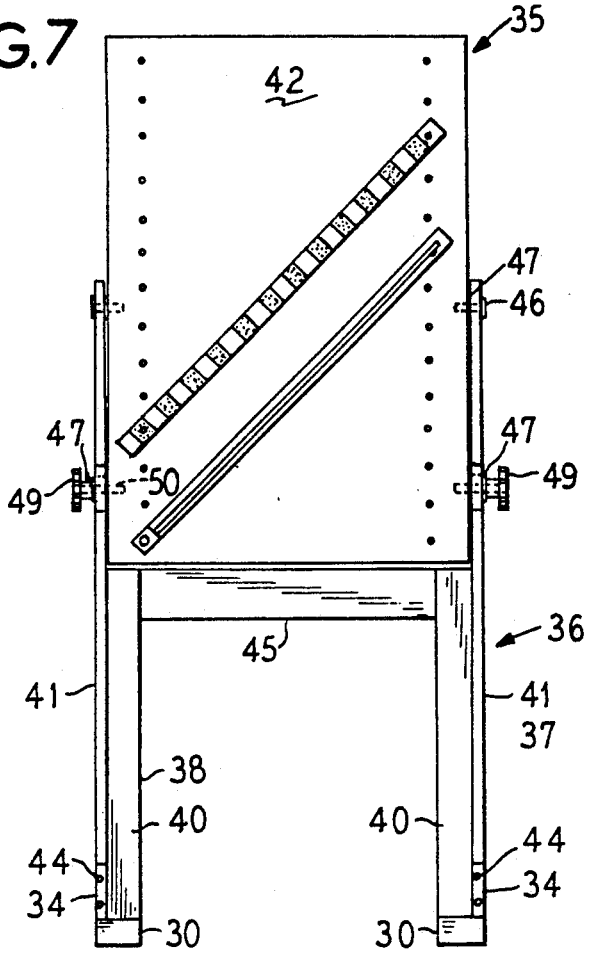
FIG. 7 is a view similar to FIG. 1, but shows one alternative embodiment of the apparatus.
Figure 8:
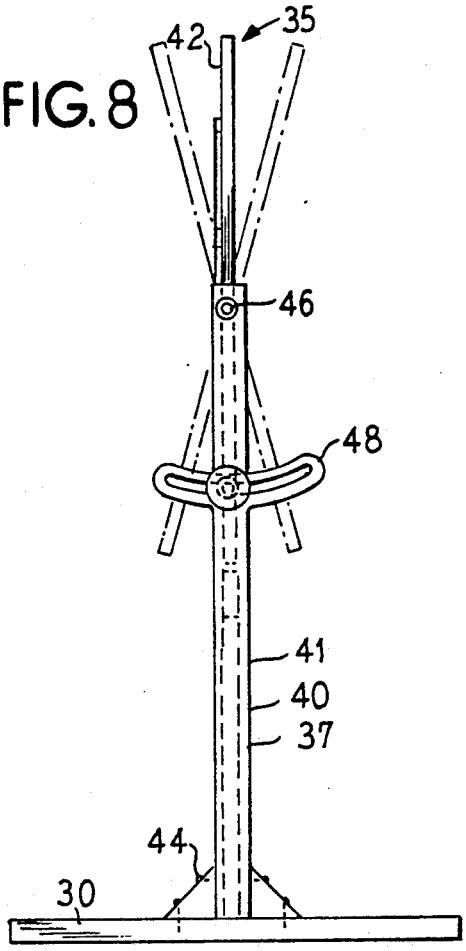
FIG. 8 is a side elevational view of the embodiment shown in FIG. 7 wherein maximum forward and rearward tilt positions for the panel are shown in phantom.
Figure 9:
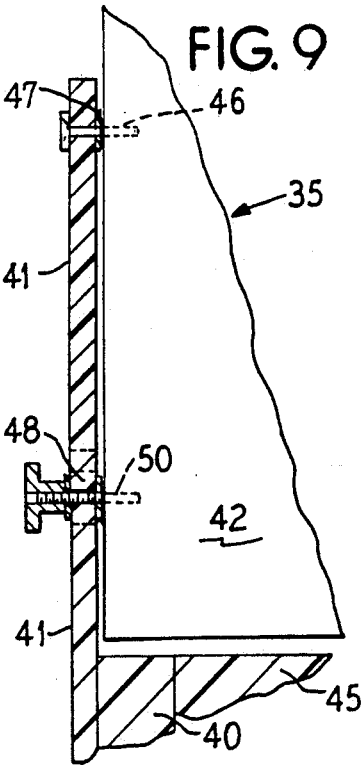
FIG. 9 is an enlarged fragmentary vertical sectional view transversely.

In certain patient therapy situations, it is desirable to provide an apparatus according to this invention wherein the panel is tiltable. The panel could thus be moved away from the patient, for example, to increase the range of motion Such an embodiment, which is designated by the numeral 35, is shown in FIGS. 7–9.

Apparatus embodiment 35 incorporates a frame assembly 36 which includes a pair of supports 37 and 38, each one of which has a horizontally extending floor engaging member 30 and an upstanding preferably vertical member 40 extending from a mid-region of each member 39. A pair of side strips 41 is provided, each one thereof extending along the opposed outside edge of a different one of the vertical members 40 and being adhered thereto by an adhesive or the like (not shown). While the vertical members 40 each extend upwardly only to a location that is just below the bottom edge of the panel 42, the side strips 41 extend further upwardly to a location somewhat beyond the mid-line region of the panel 42 of the apparatus 35. Opposite side edges of each side strip 41 at the lower end thereof are braced and positioned by triangular mounting braces 34, there being one pair of braces for each side strip 41. The braces 34 are fastened in place by means of screws 44 or the like. The top portions of each vertical member 40 are interconnected by a cross brace 45 to provide a rigid construction.

Each opposed side of panel 42 is pivotally associated with an adjacent side strip 41 by means of a pair of opposed stub shafts 46 that extend through an upper end portion of each side strip 41 and into the panel 42. A flat retaining washer ring 47 is positioned about each shaft 46 between the panel 42 and the adjacent strip 41.

Pivotal movements of the panel 42 relative to the side strips 41 and the frame assembly 36 are limited by cooperating screw clamp assemblies 47 (paired) and a pair of arcuately slotted guidance members 48 (paired). Each screw clamp assembly 47 is functionally associated with a different one of the guidance members 48. The arcuate slot corresponds to the arcuate path of the panel 42 during its pivotal movements and imposes a maximum extension on such movements.

When the knob 49 of one screw clamp assembly 47 is tightened, the assembly is clamped against opposing sides of the associated guidance member 48, thereby restricting movement. Each slotted guidance member 48 is mounted across each side strip 41. Opposed upper and lower sockets (not detailed) in each member 48 are adapted to receive the opposed upper and lower end sections of each side strip 41. The guidance member 48 is conveniently formed of a molded metal, a plastic, such as glass-filled polyethylene terephthalate, or the like. Alternatively, the strips 41 and the slotted guidance member 48 can comprise an integral, one-piece molded construction and can be formed of metal or plastic.

The forward end region 50 of each screw clamp assembly 47 is received in an opposed relationship to the other thereof within a receiving channel (not detailed) that is provided in each side of the panel 42. Thus, pivotal movement of panel 42 about shafts 46 (paired) is limited by the combination of slotted guidance members 48 and screw clamp assemblies 47. A present preference is for the panel 42 to have a tilt angle of about 15–30 degrees relative to vertical; however, larger or smaller tilt angles can be employed, if desired.

Figure 10:
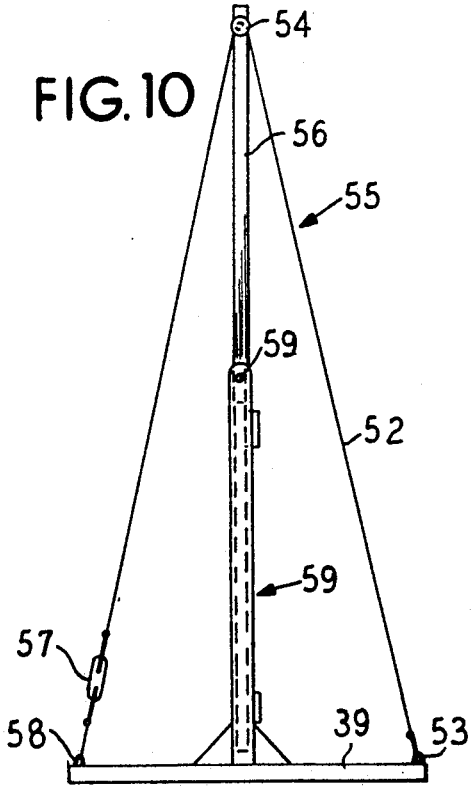
FIG. 10 is a side elevational view similar to FIG. 2, but showing another alternative embodiment of an apparatus according to the present invention.

Another apparatus embodiment is designated by the numeral 55 and is shown in FIG. 10. The frame assembly 59 of embodiment 55 is similar to that of embodiment 35 except that, in place of the slotted guidance members 48 and the associated screw clamp assembly 47, a flexible wire rope 52 or the like is extended from a connector hook 53 on one end of frame member 39 diagonally upwards to a capstan 54 located at a top side edge of panel 56. The wire rope 52 is wrapped around the capstan 54 and is brought diagonally down into engagement with one end of a turnbuckle 57. The opposite end of the turnbuckle 57 is associated with a connector hook 58 on an opposite end of frame member 39.

As shown in FIG. 10, the panel 56 is held in a vertical configuration. However, the panel 56 is pivotable about a pair of opposed stub shafts 59 (arranged in the manner of stub shafts 46 in embodiment 35). Thus, once the panel 56 is pivoted to a desired angle about the shafts 59, the wire rope is wound around the capstan 54 and fixed to the turnbuckle 57 which is then tightened to produce the desired stabilization or fixing of the panel 56 in a desired tilted position.

The present invention further provides a new and useful therapeutic method for providing motor improvement in a neurologically and/or orthopedically disordered limb of a patient. The method aims to increase the functional capacity of a patient who has suffered a neuromuscular and/or orthopedic disorder, such as, in the case of the nervous system, stroke, multiple sclerosis, spinal cord injury, peripheral nerve injuries, and the like, and, in the case of orthopedic conditions, fractures, back injuries, amputations, joint replacement, and the like.

The method also can aid patients suffering from pediatric problems, such as sensory integrative dysfunction, vestibular bilateral integration disorder, gravitational insecurity, dyspraxia, and, the like. The method utilizes proprioceptive neurofacililation (PNF) patterns and techniques in combination with a controlled and measurable activity to improve motor output, for example, the range of motion, strength and endurance.

The method involves positioning a patient with a neurologically and/or orthopedically disordered limb in spaced, adjacent relationship to an upstanding panel means (such as is provided by the apparatus of this invention or otherwise). Preferably this panel means extends upwardly from a base or bottom location which preferably is somewhat above a lower repose position for the extremity of the limb (that is, the hand) although other spatial configurations can be employed, if desired. The panel means is also preferably spatially further oriented so as to be generally adjacent to (that is, so as to lie along) an arcuate pathway that is traversed by the limb extremity when the limb is raised and moved upwardly by the patient, although other spatial configurations can also be employed.

The panel means is associated with a straight member, such as one of the elongated members described above, and the elongated member is preferably oriented diagonally across the face of the panel means that is adjacent to the patient. This orientation is preferably such that the elongated member lies approximately along the arcuate pathway followed by the patient's limb extremity during its traversal. However, other orientations for the particular elongated member being used can be employed, as desired by the therapist.

During use, a portable marker means can be releasably positioned by the patient at a desired location. This marker means includes association means that is engagable with the releasable attachment means substantially upon contact therewith.

Thus, the patient raises his limb and engages the portable marker means with the releasable attachment means, whereupon the patient can release the marker means and return his limb to the starting repose position, or the like. Over time, and after many repetitions of the particular exercise, the improvements in motor function of a limb can be gauged by the increase in the height attained by the patient in positioning the portable marker along the elongated member.

Other embodiments applications and techniques of use will be apparent to those skilled in the art. No undue limitations are to be implied or inferred from the foregoing description.

What is claimed is:

1. A therapeutic apparatus for motor improvement comprising in combination:

(a) frame means including floor engaging portions and upstanding support portions;

(b) panel means held in spaced relationship to a floor including means for mounting said panel means to said support portions;

(c) at least one elongated member, each member being vertically adjustable and diagonally mounted across said panel means and including means for mounting said elongated member to said panel means, each elongated member having associated therewith releasable attachment means; and (d) releasably supportable portable marker means including means engagable with said releasable attachment means substantially upon contact therewith.

2. The apparatus of claim 1 wherein one of said elongated members comprises a straight member calibrated in inch units or metric units.

3. The apparatus of claim 1 wherein one of said elongated members is provided with a plurality of adhered, longitudinally regularly spaced strips of material which includes a surface comprised of a self-adhering releasable fastening material.

4. The apparatus of claim 3 wherein said releasable fastening material is of the hook and loop type and said portable marker means includes a surface portion that is provided with a hook and loop material that is releasably engagable with said releasable fastening material.

5. The apparatus of claim 1 wherein said releasable attachment means includes a dowel-type rod attached at a lower portion so that the rod extends in spaced, parallel relationship along said elongated member to an open end thereof.

6. The apparatus of claim 5 wherein said portable marker means comprises ring means that is mountable over said rod end portion and is slidably engagable with said rod means.

7. The apparatus of claim which incorporates a pair of elongated members with releasable attachment means where one of the releasable attachment means comprises adhered, regularly spaced strips of material which has a surface comprised of a releasable hook and loop fastening material, and the other of which is provided with a dowel-type rod attachment that is open at one end thereof.

8. The apparatus of claim 1 which additionally includes adjustable mounting means for said panel means relative to said frame means so that said panel means is tiltable and also positionable in a fixed tilted spatial relationship relative to said frame means.

9. A method for providing motor improvement in a neurologically and/or orthopedically disordered limb of a patient comprising the steps of:

(a) positioning the patient in a spaced adjacent relationship to an upstanding panel means which generally extends upwardly from a location somewhat above a lower repose position for the extremity of said limb and which is spatially oriented so as to be generally adjacent an arcuate pathway traversed by said extremity when said limb is raised by the patient;

(b) diagonally orienting an elongated member on said panel means so that said elongated member lies approximately along said arcuate pathway, said elongated member having associated therewith releasable attachment means;

(c) releasably supporting at the extremity of said limb a portable marker means which includes association means that is engagable with said releasable attachment means substantially upon contact therewith;

(d) raising the limb of the patient so that the pathway is so traversed;

(e) transferring by the patient said marker means from said limb extremity into releasable engagement with said attachment means at a contact location adjacent the upper end of said pathway; and (f) lowering of the limb by the patient to said repose position.

10. The method of claim 9 wherein said elongated member is provided with a plurality of adhered regularly spaced strips of material which includes a surface comprised of a self-adhering releasable fastening material, and wherein said portable marker means has a surface portion thereof that is provided with a material which is releasably engagable with said fastening material.

11. The method of claim 9 wherein said elongated member is associated with a dowel-type rod that extends in spaced parallel relationship thereto and that is attached at a lower end portion thereof to said elongated member, and wherein said portable member means includes a ring which is engagable with said rod.

* * * * *

UNITED STATES PATENT AND TRADEMARK OFFICE

CERTIFICATE OF CORRECTION

PATENT NO. : 5,117,813

DATED : June 2, 1992

INVENTOR(S) : Kristine M. Haxton and Newell Haxton

It is certified that error appears in the above-identified patent and that said Letters Patent is hereby corrected as shown below:

On the cover page, item [56] References Cited, under the Foreign Patent Documents, change "0025560 of 1909 United Kingdom" to --0025560 5/1909 United Kingdom--.

Column 8, Claim 5, line 43, after "end" insert --portion--.

Column 8, Claim 7, line 1, after "claim" insert --5--.

Signed and Sealed this

Twentieth Day of July, 1993

*Attest:*

Michael K. Kirk

MICHAEL K. KIRK

*Attesting Officer*

*Acting Commissioner of Patents and Trademarks*